US012329291B2

(12) United States Patent
Hartenstine et al.

(10) Patent No.: US 12,329,291 B2
(45) Date of Patent: Jun. 17, 2025

(54) HEIGHT ADJUSTABLE CHILD'S CHAIR

(71) Applicant: WONDERLAND SWITZERLAND AG, Steinhausen (CH)

(72) Inventors: Zachary C. Hartenstine, Birdsboro, PA (US); Curtis M. Hartenstine, Birdsboro, PA (US)

(73) Assignee: WONDERLAND SWITZERLAND AG, Steinhausen (CH)

( * ) Notice: Subject to any disclaimer, the term of this patent is extended or adjusted under 35 U.S.C. 154(b) by 261 days.

(21) Appl. No.: 17/909,183

(22) PCT Filed: Mar. 5, 2021

(86) PCT No.: PCT/US2021/021035
§ 371 (c)(1),
(2) Date: Sep. 2, 2022

(87) PCT Pub. No.: WO2021/178767
PCT Pub. Date: Sep. 10, 2021

(65) Prior Publication Data

US 2023/0123948 A1 Apr. 20, 2023

Related U.S. Application Data

(60) Provisional application No. 62/985,959, filed on Mar. 6, 2020.

(51) Int. Cl.
*A47D 1/00* (2006.01)
*A47D 1/02* (2006.01)

(52) U.S. Cl.
CPC ..... *A47D 1/004* (2013.01); *A47D 1/023* (2017.05)

(58) Field of Classification Search
CPC ..... A47D 1/04; A47D 1/023; A47D 1/004
See application file for complete search history.

(56) References Cited

U.S. PATENT DOCUMENTS 361,527 A 4/1887 Kazanjian
383,535 A 5/1888 McPherson
(Continued)

FOREIGN PATENT DOCUMENTS

GB 320777 A 10/1929

OTHER PUBLICATIONS

International Search Report issued in corresponding International Patent Appliction No. PCT/US2021/021035 on Aug. 12, 2021, consisting of 5 pp.

(Continued)

*Primary Examiner* — Milton Nelson, Jr.
(74) *Attorney, Agent, or Firm* — Volpe Koenig

(57) ABSTRACT

In one example, a highchair has a seat and a base. The base is attached to the seat such that, when the base is disposed on a surface, the base supports the seat above the surface. The base has a plurality of legs that are rotatable so as to transition the highchair between a raised position and a lowered position. In the raised position, the seat is disposed at a first height and the plurality of legs together define a first footprint that has a first cross-sectional area in a select plane. In the lowered position, the seat is disposed at a second height, lower than the first height, and the plurality of legs together define a second footprint that has a second cross-sectional area in the select plane that is less than the first cross-sectional area.

25 Claims, 12 Drawing Sheets

(56) References Cited

U.S. PATENT DOCUMENTS

| | | | | |
|---|---|---|---|---|
| 773,787 | A | 11/1904 | Crossman | |
| 2,502,667 | A | 4/1950 | Pagett | |
| 2,971,570 | A | 2/1961 | Vander Bush | |
| 3,147,036 | A | 9/1964 | McRae | |
| 3,331,086 | A | 7/1967 | Hopkins | |
| 4,015,806 | A | 4/1977 | Cattermole | |
| 2004/0212238 | A1 | 10/2004 | Chen | |
| 2007/0029845 | A1 | 2/2007 | Riedl | |
| 2008/0048074 | A1 | 2/2008 | May | |
| 2014/0077534 | A1 | 3/2014 | Stolarz | |
| 2016/0037941 | A1* | 2/2016 | Windenberger ..... | A47D 1/023<br>297/344.12 |

OTHER PUBLICATIONS

Written Opinion issued in corresponding International Patent Application No. PCT/US2021/021035 on Aug. 12, 2021, consisting of 12 pp.

* cited by examiner

HEIGHT ADJUSTABLE CHILD'S CHAIR

CROSS-REFERENCE TO RELATED APPLICATIONS

This application claims priority to U.S. Provisional patent application No. 62/985,959, filed Mar. 6, 2020, the disclosure of which is hereby incorporated by reference as if set forth in its entirety herein.

TECHNICAL FIELD

The present disclosure relates generally to highchairs and, in particular, to height adjustment of highchairs.

BACKGROUND

A highchair is a piece of furniture having a seat that is used to support children such as babies and toddlers as they are fed. The seat is raised from the ground, so that an individual, such as an adult, may spoon-feed the child or the child can reach a table or island top. Commonly, a tray which is attached to highchair, which allows the adult to place the food on it for either the child to pick up and eat or for the food to be spoon-fed to the child.

SUMMARY

In an example, a highchair comprises a seat, and a base attached to the seat such that, when the base is disposed on a surface, the base supports the seat above the surface. The base comprises a plurality of legs that are configured to rotate, translate horizontally, or rotate and translate horizontally, so as to transition the highchair between a raised position and a lowered position. In the raised position, the seat is disposed at a first height and the plurality of legs together define a first footprint that has a first cross-sectional area in a select plane. In the lowered position, the seat is disposed at a second height, lower than the first height, and the plurality of legs together define a second footprint that has a second cross-sectional area in the select plane that is less than the first cross-sectional area.

In another example, a highchair comprises a seat, a support attached to the seat, and a base comprising a plurality of legs attached to the support such that the seat is configured to raise and lower relative to the base along a vertical direction. The highchair is configured such that raising the seat causes each of the plurality of legs to move so as to increase a footprint of the base. The highchair is configured such that lowering the seat causes each of the plurality of legs to move so as to decrease the footprint of the base.

In yet another example, a highchair comprises a base, a seat, at least one lock, and an actuator. The base comprises a plurality of legs, and a hub that is coupled to the plurality of legs and configured to translate along the plurality of legs. The seat is attached to the hub such that translation of the hub along the plurality of legs causes the seat to translate along a vertical direction. The at least one lock is configured to be transitioned between 1) a locked position, wherein each of the at least one lock engages a corresponding one of the legs so as to lock a vertical position of the seat relative to the base, and 2) an unlocked position, wherein the at least one lock is disengaged from the corresponding one of the legs so as to unlock a position of the seat relative to the base. The actuator comprises a handle and an axle, wherein the actuator is configured to convert translational movement of the handle into rotational movement of the axle, and rotational movement of the axle into translational movement of the at least one lock so as to transition the at least one lock between the locked position and the unlocked position.

In yet still another example, a method of operating a highchair comprises a step of raising a seat of the highchair from a lowered position to a raised position, wherein the raising step causes a plurality of legs of the highchair to rotate, translate outwardly along a horizontal direction, or rotate and translate outwardly along the horizontal direction, so as to increase a footprint defined by the plurality of legs.

BRIEF DESCRIPTION OF THE DRAWINGS

The following description of the illustrative embodiments may be better understood when read in conjunction with the appended drawings. It is understood that potential embodiments of the disclosed systems and methods are not limited to those depicted.

DETAILED DESCRIPTION

Figure 2:
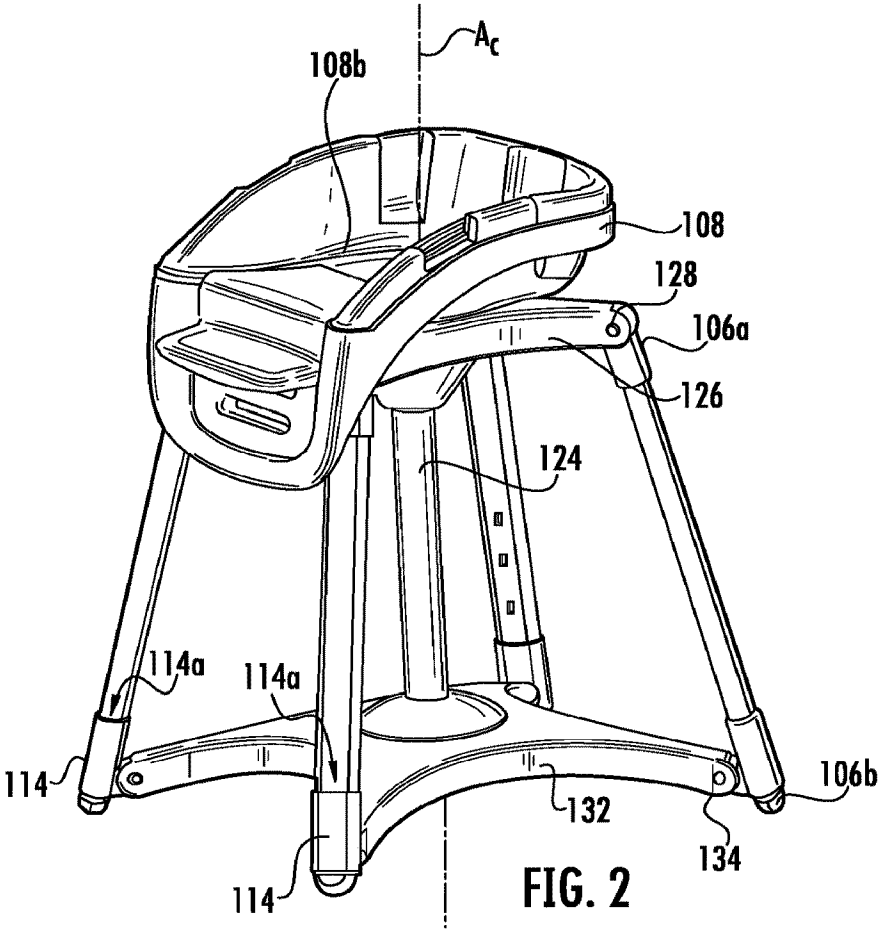
FIG. 2 shows a perspective view of the highchair of FIG. 1 in the lowered position and with the booster seat removed.

Breakfast bars, kitchen islands, and counter-height free-standing tables are being utilized more frequently in homes. As a result, many homes may include eating surfaces disposed at two or more heights. For example, a home may include eating surfaces disposed at two or more of a dining height (or standard height) (e.g., about 28 inches to about 30 inches), a counter height (e.g., about 34 inches to about 36 inches), and a bar height (e.g., about 40 inches to about 42 inches). This has led to a need for highchairs in which the seat can be raised or lowered to accommodate eating surfaces disposed at these different heights.

In conventional highchairs in which the seats that can be raised or lowered, the bases that support the seats commonly have footprints that are fixed in size. In these highchairs, as the seat is raised or lowered, the footprint does not change. However, raising the height of a seat, without increasing the footprint, can reduce the tip over force needed to tip over the highchair, thereby making the highchair more susceptible to tip over. This problem could be overcome by implementing a highchair to have a footprint that is large enough to sufficiently limit tip over in both the raised and lowered positions. However, such a footprint may be oversized for the lowered position such that the highchair occupies more space in the lowered position than needed. In many homes, space is limited. Therefore, it would be beneficial to implement a highchair with a footprint that increases in size when the seat is raised and decreases in size when the seat is lowered. Disclosed herein are examples of highchairs having footprints that can be adjusted as the highchairs are raised and lowered.

Turning to FIGS. 1 to 4, a highchair 100 is shown according to one example. In general, the highchair 100 comprises a seat 102, and a base 104 that is attached to the seat 102 such that, when the base 104 is disposed on a surface such as a floor, the base 104 supports the seat 102 above the surface. The base 104 comprises a plurality of legs 106 that are directly attached to the seat 102 or indirectly attached to the seat 102 via, for example, a support 124. The highchair 100 is configured to transition between a raised position (e.g., FIGS. 3 and 4) and a lowered position (e.g., FIGS. 1 and 2). In the raised position, the seat 102 is disposed at a first height and the plurality of legs 106 together define a first footprint $FP_1$ that has a first cross-sectional area in a select plane (e.g., P-P). In the lowered position, the seat 102 is disposed at a second height, lower than the first height, and the plurality of legs 106 together define a second footprint $FP_2$ that has a second cross-sectional area in the select plane (e.g., P-P), where the second cross-sectional area is less than the first cross-sectional area. Thus, the highchair 100 is configured such that the seat 102 is configured to raise and lower relative to the base 104 along a vertical direction V.

The highchair 100 is configured such that raising the seat 102 causes each of the plurality of legs 106 to move (e.g., i) rotate, ii) translate along at least one horizontal direction, perpendicular to the vertical direction V, iii) translate along the vertical direction, or iv) any combination thereof), so as to increase a footprint of the base 104. Further, the highchair 100 is configured such that lowering the seat 102 causes each of the plurality of legs 106 to move (e.g., i) rotate, ii) translate along at least one horizontal direction, perpendicular to the vertical direction V, iii) translate along the vertical direction, or iv) any combination thereof) so as to decrease the footprint of the base 104. The highchair 100 can be configured such that just a portion, such as a lower end or foot of each leg 106, can translate along the at least one horizontal direction as illustrated in FIGS. 1 to 4, or such that an entirety of each leg 106, including an upper end, translates along the at least one horizontal direction. The highchair 100 can be configured such that raising the seat 102 increases a space between the seat 102 and the base 104, and lowering the seat 102 decreases the space between the seat 102 and the base 104. In at least some examples, the seat 102 can be raised and lowered and the footprint can be increased and decreased without changing a length of one or more of the plurality of legs 106.

Figure 1:
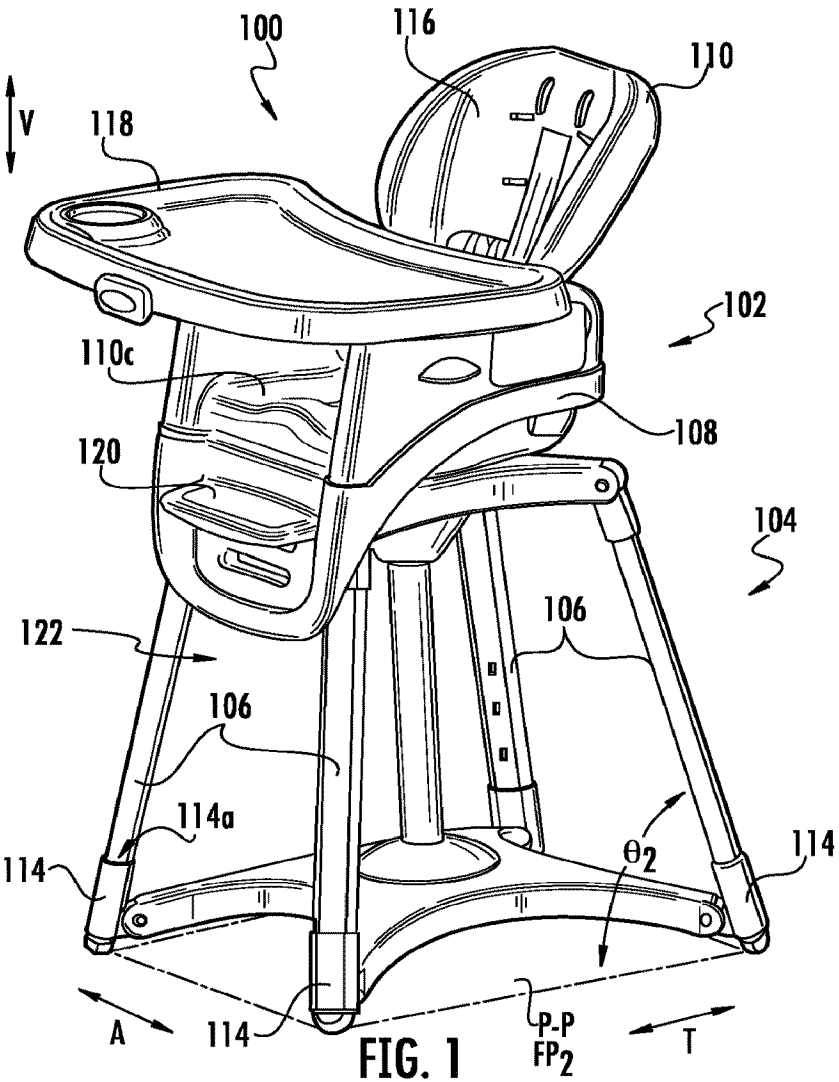
FIG. 1 shows a perspective view of a highchair according to one example in a lowered position and with a booster seat.
Figure 4:
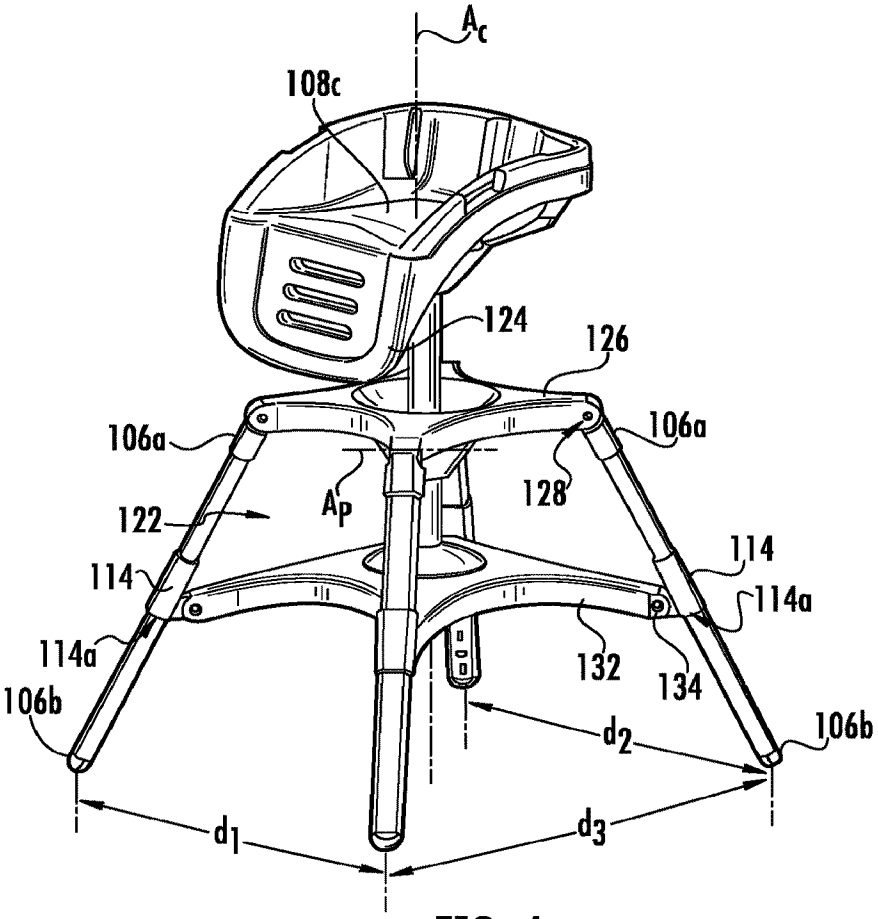
FIG. 4 shows a perspective view of the highchair of FIG. 1 in a raised position and with the booster seat removed.
Figure 3:
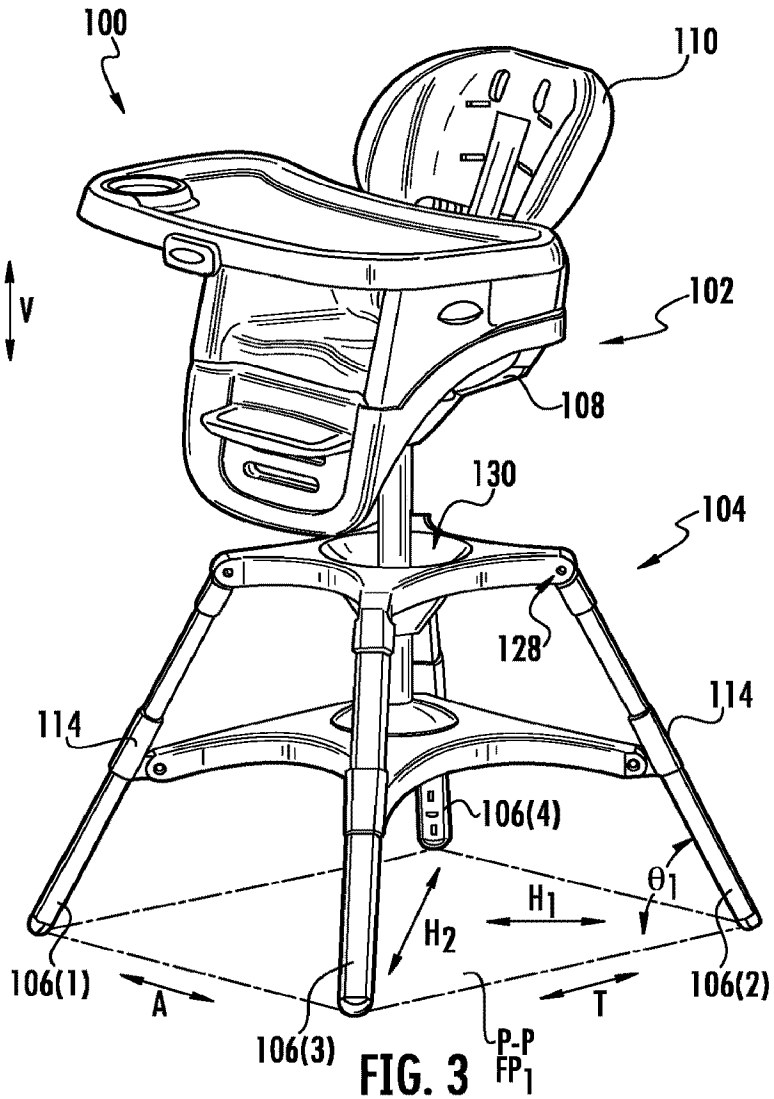
FIG. 3 shows a perspective view of the highchair of FIG. 1 in a raised position and with the booster seat.
Figure 6:
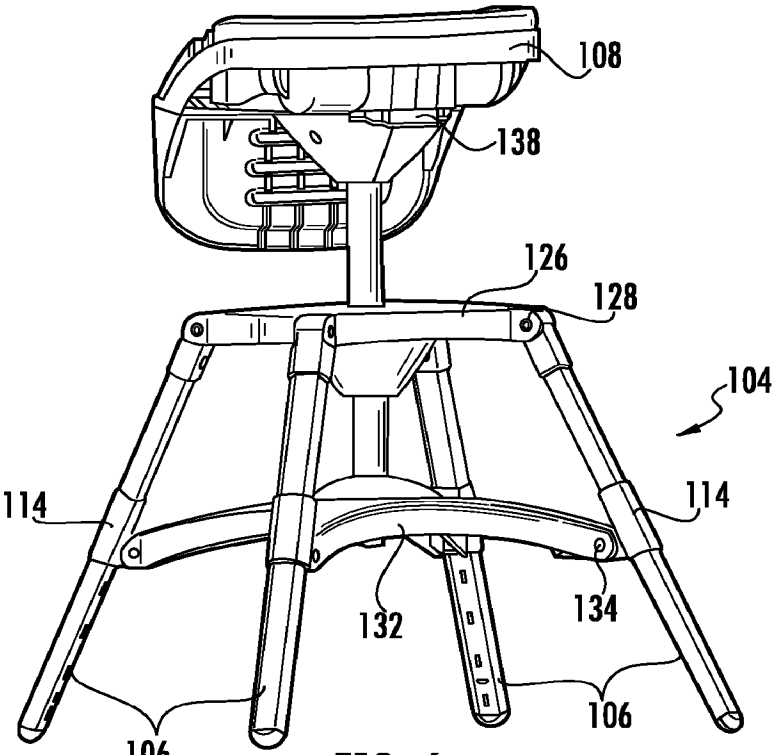
FIG. 6 shows another perspective view of the highchair of FIG. 1 in the lowered position with the booster seat removed.
Figure 5:
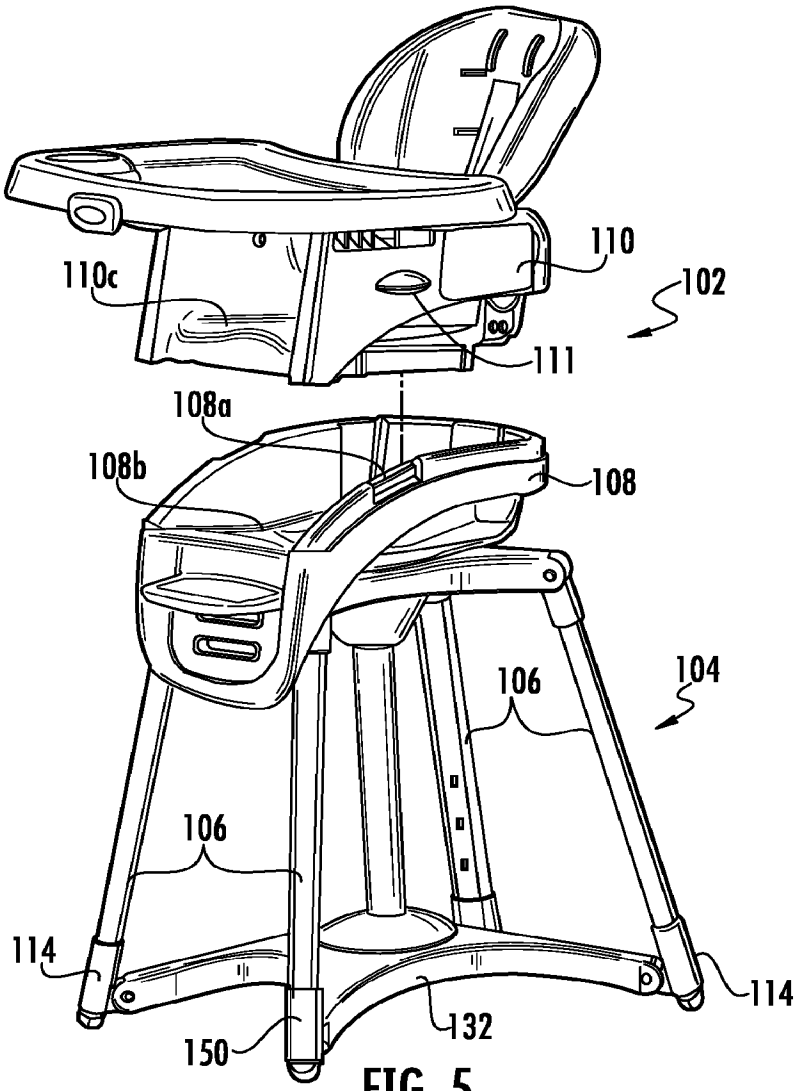
FIG. 5 shows a partially exploded perspective view of the highchair of FIG. 1 in the lowered position.
Figure 7:
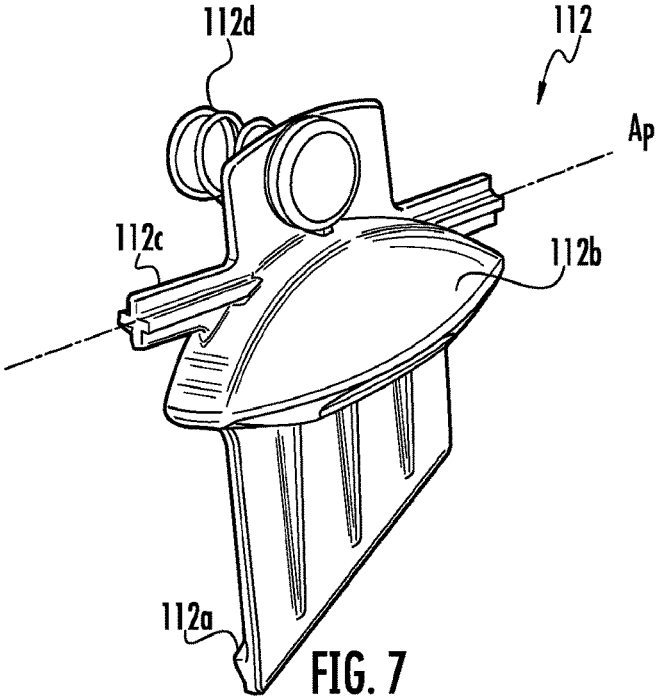
FIG. 7 shows a perspective view of a seat latch or fastener that is configured to selectively lock the booster seat to a toddler seat of the highchair of FIG. 1.
Figure 8:
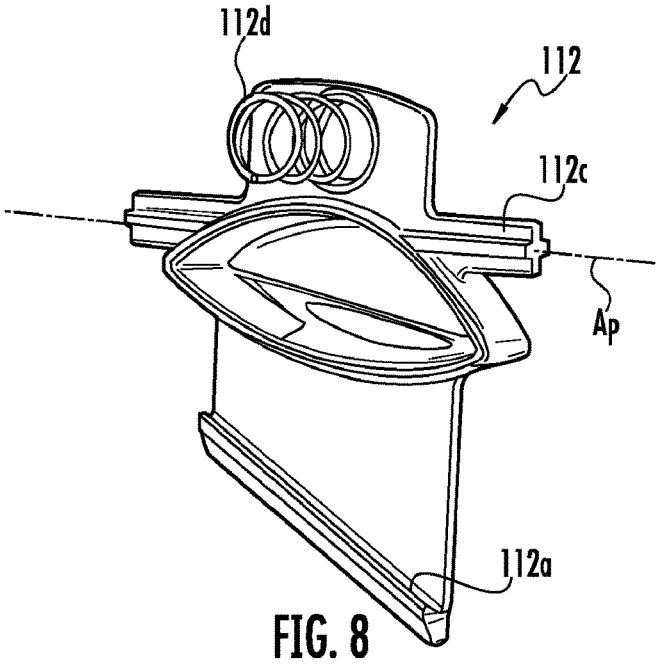
FIG. 8 shows another perspective view of the seat latch or fastener of FIG. 7.
Figure 9:
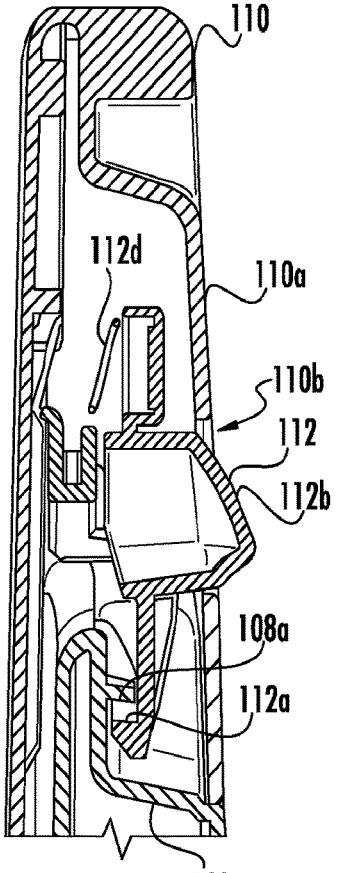
FIG. 9 shows a cross-sectional view of a portion of the highchair of FIG. 1, illustrating the seat latch or fastener securing the booster seat to the toddler seat.

With continued reference to FIGS. 1 to 4, the features of the highchair 100 will be discussed in further detail. The seat 102 can be any suitable seat for supporting a child such as an infant and/or toddler. In some examples, the seat 102 can a booster seat 110, a toddler seat 108, or a booster seat 110 and a toddler seat 108. FIGS. 1, 3, and 5 show one example of a seat 102 having a toddler seat 108, and a booster seat 110 that is removably couplable to the toddler seat 108. FIGS. 2, 4, and 6 show a toddler seat 108 without the booster seat 110 coupled thereto (e.g., with the booster seat 110 removed or omitted).

The booster seat 110 and/or the toddler seat 108 can have a seat latch or fastener that is configured to selectively lock the booster seat 110 and the toddler seat 108 to one another. FIGS. 5 and 7-9 show one example of a seat latch or fastener 112 that is carried by the booster seat 110, although it will be understood that the seat latch or fastener can be implemented in any other suitable manner. The seat latch or fastener 112 includes an engagement surface 112*a* (herein referred to as a latch engagement surface) that is configured to engage a corresponding engagement surface 108*a* (herein referred to as a seat engagement surface) of the toddler seat 108 so as to form an interference therebetween that prevents the booster seat 120 from being removed from the toddler seat 108. The seat latch or fastener 112 includes an actuation surface 112*b* that is configured to be engaged by a user so as to move the latch between a locked position, wherein the latch engagement surface 112*a* engages the seat engagement surface 108*a* to form the interference, and an unlatched position, wherein the latch engagement surface 112*a* is disengaged from the seat engagement surface 108*a* and the interference is removed. In the example of FIGS. 5 and 7-19, the actuation surface 112*b* defines a push button that extends through an opening 110*b* in a body or shell 110*a* of the booster seat 110. The seat latch or fastener 112 can include a pivot 112*c* that defines a pivot axis $A_p$ of the seat latch or fastener 112, about which the seat latch or fastener 112 is configured to rotate to transition between the locked and unlocked positions. The seat latch or fastener 112 can include a spring 112*d* that biases the seat latch or fastener 112 towards the locked position. For example, the spring 112*d* can bias the seat latch or fastener 112 to rotate about the pivot axis $A_P$ to the locked position. It will be understood that the spring 112*d* can be any suitable elastic body or device that recovers its original shape when released after being distorted.

The seat 102 can have a seat pan that defines a seating surface that is configured to support a child thereon. In the example of FIGS. 1 to 4, the toddler seat 108 has a seat pan

108*b* and the booster seat 110 has a separate seat pan 110*c*, although it will be understood that, in alternative examples, the toddler seat 108 and booster seat 110 can utilize a single, shared seat pan. The seat 102 can optionally include one or more, up to all, of a seatback 116, a tray 118, and a footrest 120. The tray 118 can be configured to removably couple to the seat 102. The footrest 120 can be removably coupled, or fixedly attached, to the seat 102.

The plurality of legs 106 comprises at least two legs, such as at least three legs, at least four legs, or more than four legs. The legs 106 are spaced from one another so as to define a space 122 therebetween. The legs 106 are spaced from one another along at least one direction, and are configured to move along the at least one direction to cause a footprint of the base 104 to increase and decrease along the at least one direction. FIGS. 1 to 4 show a specific example, where the base 104 comprises four legs 106(1), 106(2), 106(3), and 106(4). The first and second legs 106(1) and 106(2) are spaced opposite from one another along a first horizontal direction $H_1$. The third and fourth legs 106(3) and 106(4) are spaced opposite from one another along a second horizontal direction $H_2$, angularly offset from the first horizontal direction $H_1$. The first and second horizontal directions $H_1$ and $H_2$ are perpendicular to the vertical direction V. In some examples, the second horizontal direction $H_2$ can be perpendicular to the first horizontal direction $H_1$.

The first leg 106(1) and third leg 106(3) can define a first pair of legs that are spaced from one another along a lateral direction A, perpendicular to the vertical direction V. The second leg 106(2) and fourth leg 106(4) can define a second pair of legs that are spaced from one another along the lateral direction A. The second pair of legs can be spaced from the first pair of legs along a transverse direction T, perpendicular to both the vertical direction V and the lateral direction A. The legs 106(1) and 106(3) of the first pair can spaced from one another along the lateral direction A by a first dimension $d_1$, the legs 106(2) and 106(4) of the second pair can be spaced from one another along the lateral direction A by a second dimension $d_2$, and the first and second pairs of legs can be spaced from one another along the transverse direction T by a third dimension $d_3$.

In some examples, the first, second, and third dimensions $d_1$, $d_2$, $d_3$ can be equal to one another. In such examples, the force needed to tip over the highchair 100 in the transverse direction T can be substantially the same as the force needed to tip over the highchair 100 in the lateral direction A. This may be advantageous when the seat 102 is configured to rotate about a vertical axis relative to the base 104 such that the seat 102 can selectively face the lateral direction A or transverse direction T. In alternative examples, the third dimension $d_3$ can be greater than the first and second dimensions $d_1$ and $d_2$, and optionally, the first and second dimensions $d_1$ and $d_2$ can be equal to one another. In such alternative examples, the force needed to tip over the highchair 100 in the transverse direction T can be greater than the force needed to tip over the highchair in the lateral direction A. This configuration may be advantageous when the seat 102 is rotationally fixed relative to the base 104 to face the transverse direction T. For instance, a tip-over force resulting from a leaning child may be more significant in the transverse direction T than in the lateral direction A. Thus, such a configuration would allow for greater stability along the transverse direction T, while limiting a dimension $d_1$, $d_2$ of the base 104 along the lateral direction A.

In alternative examples (not shown), the base 104 can have a different number of legs 106 than that shown. For instance, the base 104 can have two or more legs, three or more legs, four or more legs, or five or more legs. In some examples, the base 104 can have just a single pair of legs, and the legs of the single pair can be spaced opposite from one another along one of the horizontal directions. For instance, in some examples (not shown), the plurality of legs 106 can include a single pair of legs that are spaced apart from one another along a select one of a lateral direction A (side-to-side) and a transverse direction T (front-to-back). The legs can move towards and away from one another along the select one of the lateral direction A and transverse direction T so as to cause the footprint to increase and decrease along the select one of the lateral direction A and the transverse direction T. In other examples, the base 104 can have three legs. The three legs can be equidistantly spaced along a circumferential direction in the select plane P-P, although examples of this disclosure are not so limited. The three legs can move towards and away from one another so as to increase and decrease the footprint along three directions.

Figure 10:
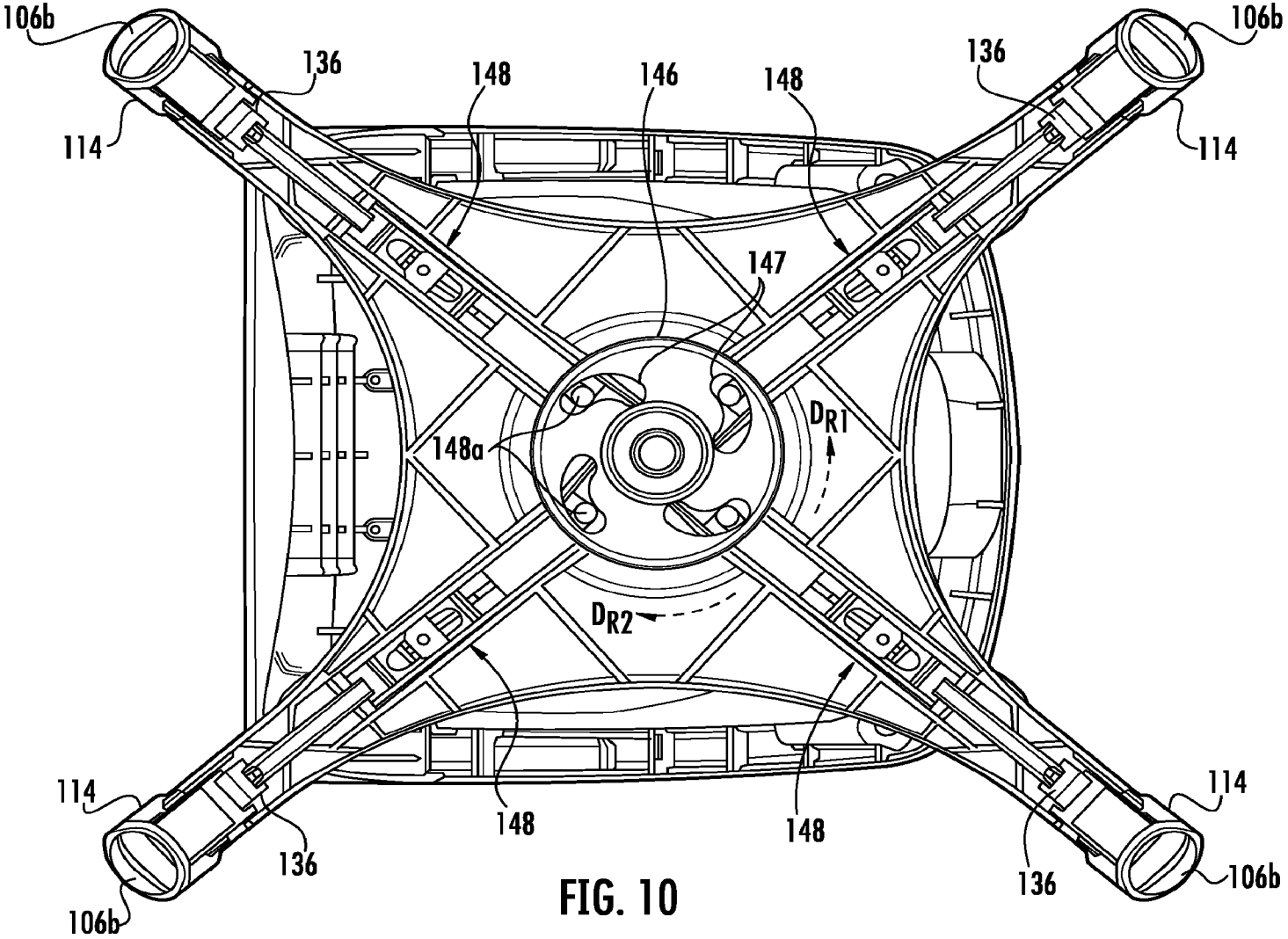
FIG. 10 shows a bottom plan view of the highchair of FIG. 1.
Figure 11:
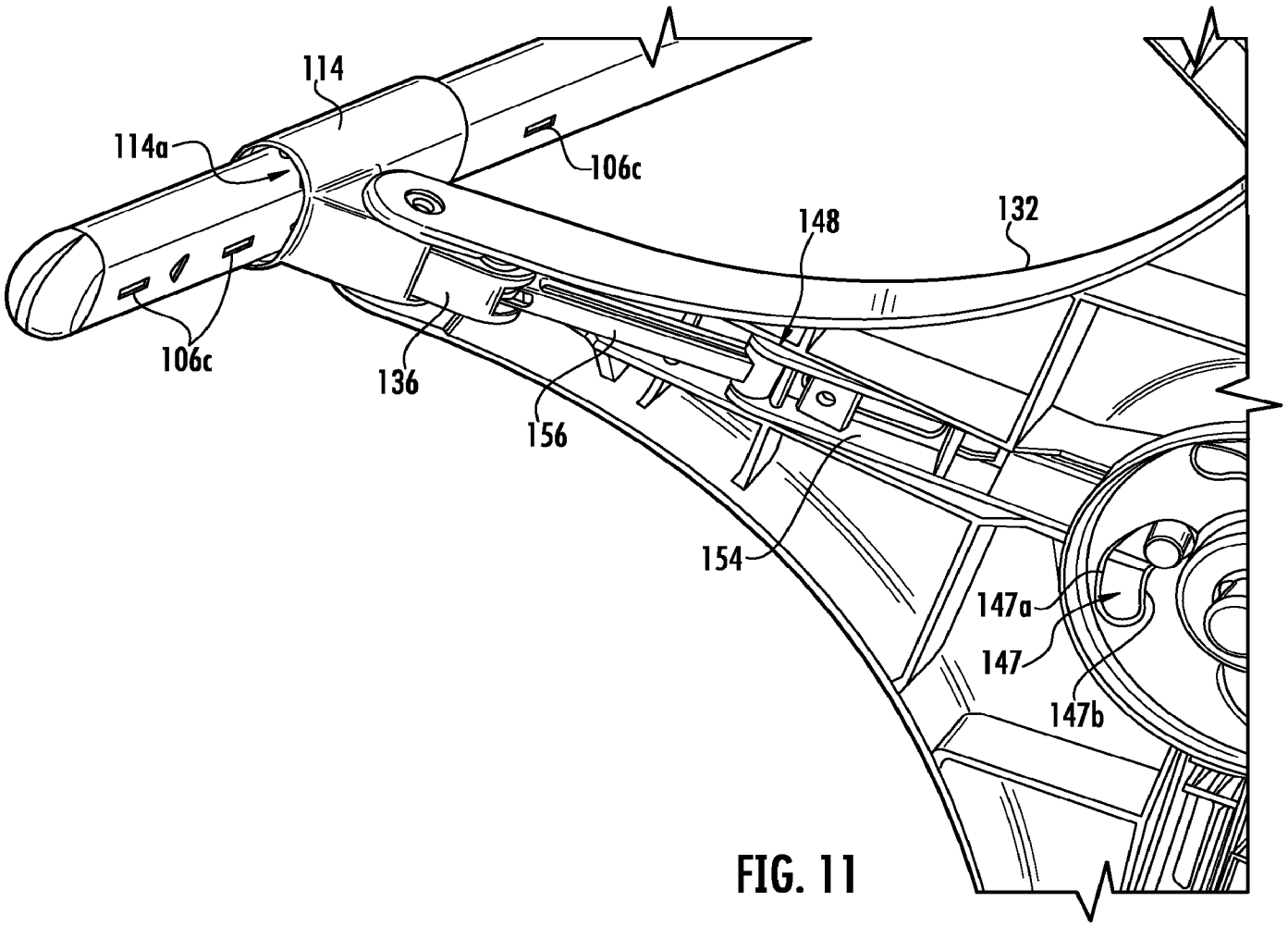
FIG. 11 shows a perspective view of a bottom portion of the highchair of FIG. 1.
Figure 12:
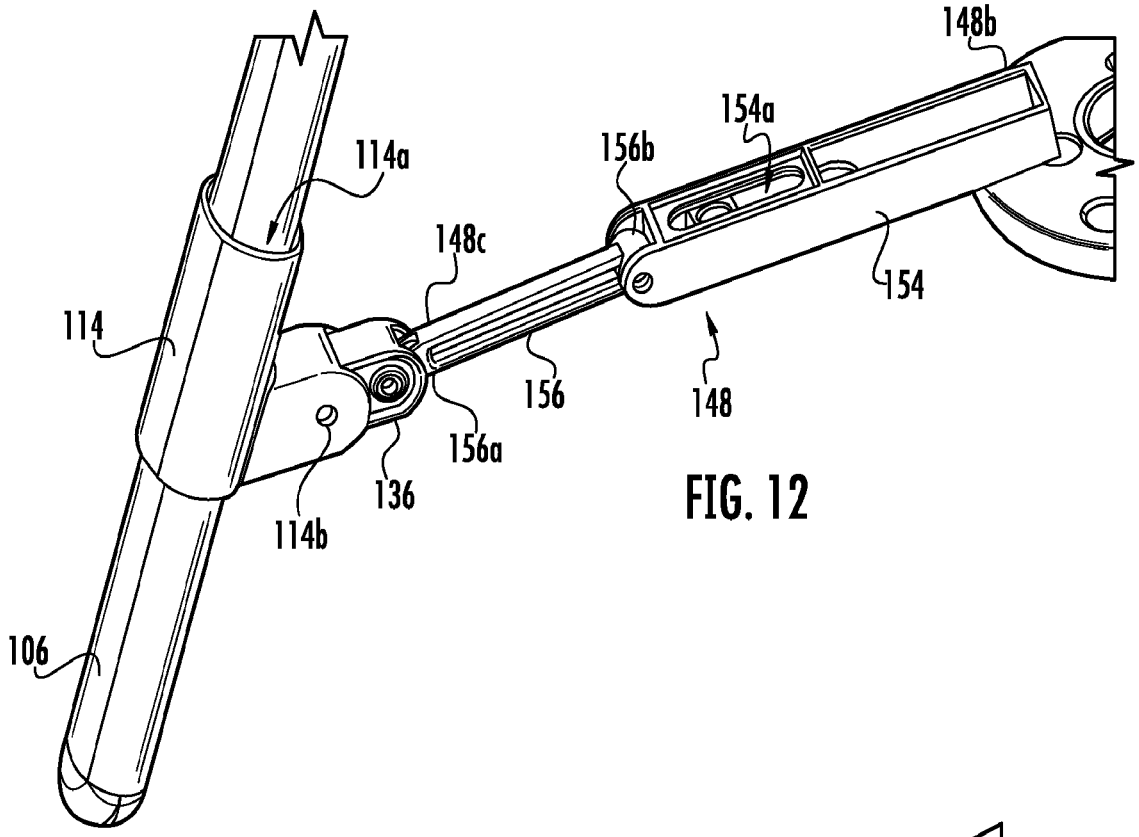
FIG. 12 shows a perspective view of a bottom portion of the highchair of FIG. 1 with a lower hub removed to show a lower linkage.
Figure 13:
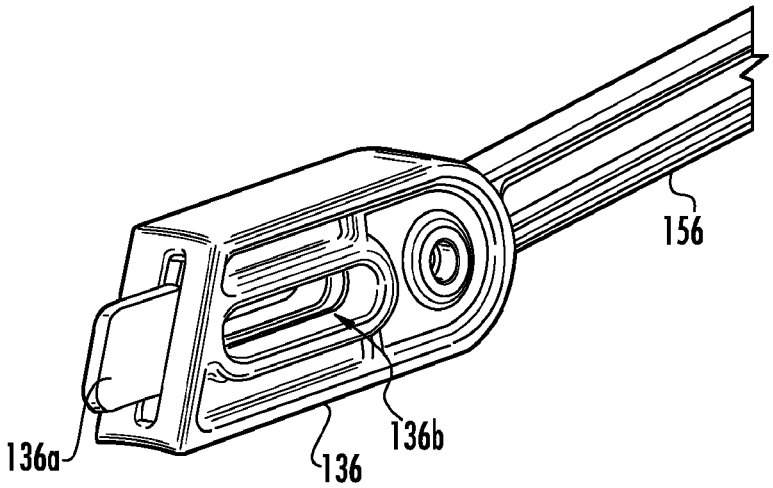
FIG. 13 shows a perspective view of a lock of the highchair of FIG. 1.
Figure 14:
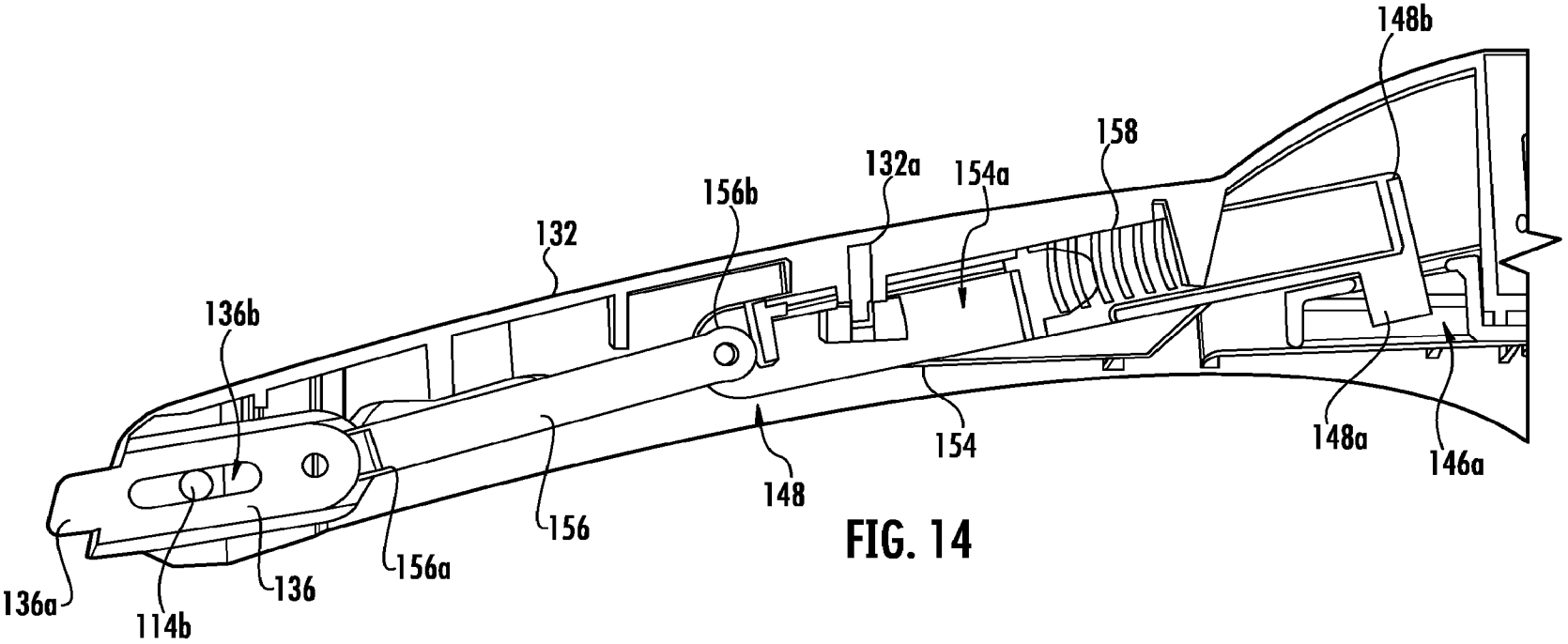
FIG. 14 shows a cross-sectional view of a portion of a lower hub and lower linkage of the highchair of FIG. 1.

Each leg 106 can have any suitable shape. For example, each leg 106 can be configured as a tube (an example of which is shown in FIGS. 1 to 4), as a flat plate, as a plate that is curved or bent on opposing sides (e.g., "u"-shaped), or any as other suitable shape. In examples that implement just one pair of legs, each leg in the pair can have a width along a direction that is perpendicular to the select one of the lateral direction A and transverse direction T that is greater than a width of the seat 102 along the same direction. Each leg 106 is preferably formed from metal, such as steel, but can be formed from any suitable material or materials. Each leg 106 can have an upper end 106*a* and a lower end 106*b*. Each leg 106 can have a length from its upper end 106*a* to its lower end 106*b*. In some examples, one or more, up to all, of the legs 106 can have a fixed length. In other examples, one or more, up to all, of the legs 106 can have an adjustable length (e.g., the leg can have telescoping portions such that the leg extends and retracts). The upper end 106*a* of each leg 106 can be offset from the lower end 106*b* of the leg 106 along an axis $A_L$. The lower end 106*b* of each leg 106 can be offset outwardly from the upper end 106*a* of the leg 106 with respect to the vertical direction V and a horizontal direction H. As can be seen in FIG. 10, each leg 106 can extend away from one or more, up to all, of the other legs 106 as the leg 106 extends from the upper end 106*a* of the leg 106 to the lower end 106*b* of the leg 106.

When supported on a surface, each leg 106 extends from the surface at a first angle $\theta_1$ when the highchair 100 is in the raised position (FIGS. 3 and 4) and a second angle $\theta_2$ when the highchair 100 is in the lowered position (FIGS. 1 and 2). The second angle $\theta_2$ is different from the first angle $\theta_1$. For example, the second angle $\theta_2$ can be smaller than the first angle $\theta_1$. One or both of the first $\theta_1$ and second angles $\theta_2$ can be an acute angle. Each angle $\theta_1$ and $\theta_2$ can be measured from an axis $A_L$ of a corresponding leg 106 to the surface. Note that the first angle $\theta_1$ can be the same for each of the legs 106, or the first angle $\theta_1$ of one or more of the legs 106 can be different from the first angle $\theta_1$ of one or more other legs 106. Similarly, the second angle $\theta_2$ can be the same for each of the legs 106, or the second angle $\theta_2$ of one or more of the legs 106 can be different from the second angle $\theta_2$ of one or more other legs 106.

The highchair 100 can comprise a support 124 that attaches the seat 102 to the base 104. The support 124 extends downward from the seat 102. The support 124 is preferably formed from metal, such as steel, but can be formed from any suitable material or materials. In some examples, the seat 102 can be rotatable relative to the support 124, and in other examples, the seat can be 102 can be rotationally fixed relatively to the support 124. The support 124 can be attached (e.g., translatably fixed) to the seat 102 such that movement of the support 124 along the vertical direction V causes movement of the seat 102 along the vertical direction V. The support 124 can comprise a shaft. The support 124 can be shaped as a tube or pole, or can have any other suitable shape such as (without limitation) a plate, a block, etc. The support 124 can have a length along the vertical direction V that is greater than a dimension (e.g., diameter) of the support 124 along a horizontal direction. The support 124 can have a central axis $A_C$. The central axis $A_C$ can define a central axis of the highchair 100.

The base 104 can comprise a plurality of couplers 114 that couple the support 124 to the legs 106. In some examples, as in FIGS. 1 to 4, the couplers 114 can couple the support 124 to the plurality of legs 106 such that each coupler 114 is translatable along a respective one of the plurality of legs 106 so as to cause the support 124 to translate along the vertical direction V. In other examples, as discussed below in relation to FIGS. 18 and 19, the couplers 114 can couple the support 124 to the plurality of legs 106 such that each coupler 114 is translatably fixed to the legs 106. The couplers 114 can indirectly couple the support 124 to the plurality of legs 106 as shown or can directly couple the support 124 to the legs 106. Each leg 106 can define a track that guides a coupler 114 to translate along the track. In some examples, as illustrated in FIGS. 1 to 4, each of one or more of the couplers 114 comprises a collar defining a hole **114*a* that receives a respective one of the plurality of legs 106 therethrough such that the collar is slidable along the respective leg 106. Thus, each respective leg 106** has an external surface that defines an external track, and the collar can be configured to slide along the external track.

Figure 20:
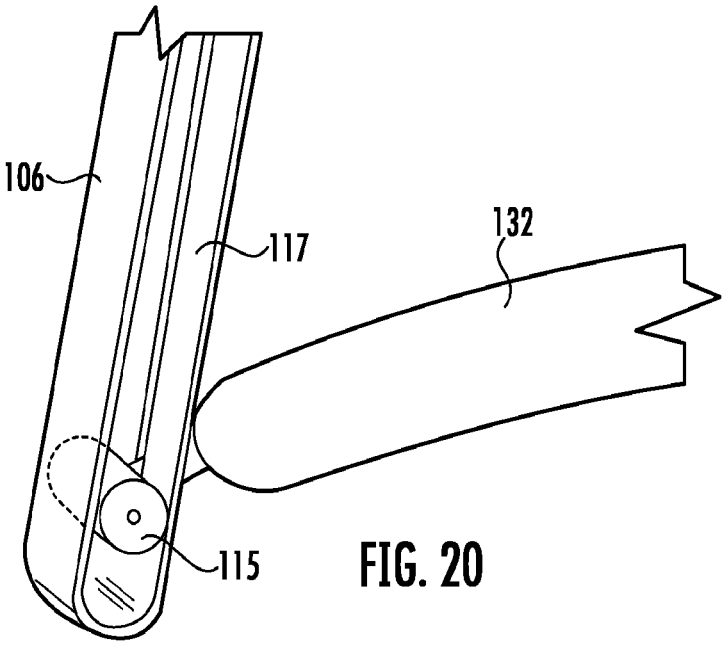
FIG. 20 shows a schematic view of a coupler coupled to a leg of the highchair of FIG. 1 according to another example, the coupler comprising a wheel.
Figure 21:
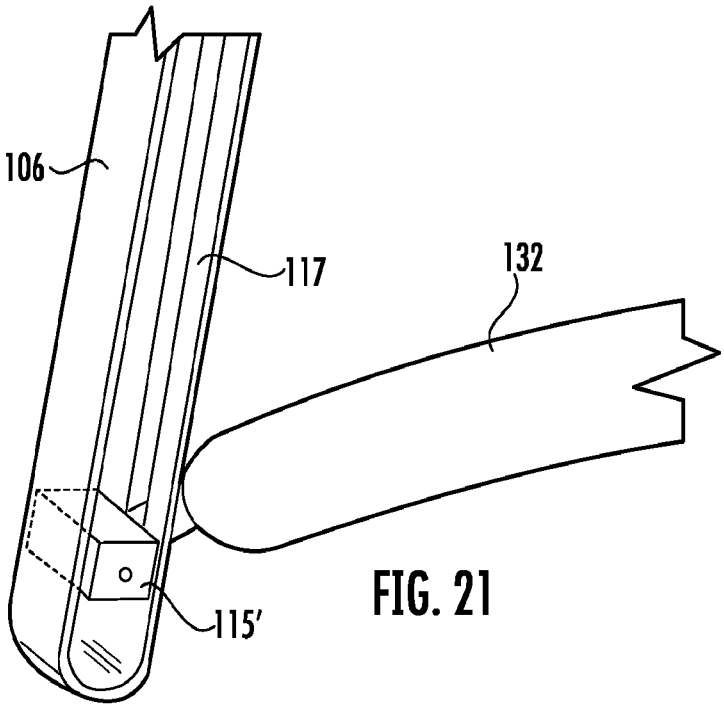
FIG. 21 shows a schematic view of a coupler coupled to a leg of the highchair of FIG. 1 according to another example, the coupler comprising a slider.

It will be understood that, in alternative examples, each of one or more of the couplers 114 can be configured in a manner other than a collar to translate along a respective leg 106 and/or each of one or more of the legs 106 can have an internal surface that defines an internal track. For example, with reference to FIG. 20, each of one or more of the couplers 114 can comprise at least one wheel 115 that is configured to ride along a track, such as an internal track 117, defined by a respective one of the plurality of legs 106. As another example, with reference to FIG. 21, each of one or more of the couplers 114 can be comprise at least one foot or slider 115' that is received in and configured to slide along an internal track defined by a respective one of the plurality of legs 106. As yet another example (not shown), each of one or more of the couplers 114 can comprise a block or carriage of a linear bearing, where the respective leg 106 comprises the track or rail of the linear bearing.

The base 104 can comprise an upper hub 126. The upper hub 126 can be formed from injection molded plastic, or any other suitable material or materials. The upper hub 126 can be coupled to each of the plurality of legs 106 such that the legs 106 are 1) fixed to the upper hub 126 with respect to translation along the vertical direction V, and 2) configured to rotate relative to the upper hub 126. Each leg 106 can be attached to the upper hub 126 at a pivot 128 that defines a pivot axis $A_P$. Each leg 106 can be configured to rotate within a single plane. For example, the legs 106(1) and 106(2) can each be configured to rotate in a plane that extends along the first horizontal direction $H_1$ and the vertical direction V. The legs 106(3) and 106(4) can each be configured to rotate in a plane that extends along the second horizontal direction $H_2$ and the vertical direction V. In at least some examples, the upper hub 126 can be pivotably attached to the upper end **106*a* of each leg 106**.

The upper hub 126 can have a dimension $d_4$ (see FIG. 16) from the first leg 106(1) to the second leg 106(2) along the first horizontal direction $H_1$. Similarly, the upper hub 126 can have a dimension $d_5$ (see FIG. 16) from the first leg 106(1) to the second leg 106(2) along the second horizontal direction $H_2$. The upper hub 126 can define an opening 130 therethrough that is configured to receive the support 124. The support 124 can be received through the opening 130 such that the support 124 translates through the opening 130 along the vertical direction V. The opening 130 can be sized to conform to a size of the support 124 so as to guide the support 124 along the vertical direction and to limit movement of the support 124 horizontally. In some examples, the support 124 can have a keyed shape, such as a non-circular shape, that is configured to conform to a keyed shape of the opening 130. The keyed shapes can limit rotation of the support 124 relative to the legs 106 about the central axis $A_C$.

The base 104 can comprise a lower hub 132, disposed below the upper hub 126. The lower hub 132 can be formed from injection molded plastic or any other suitable material or materials. The lower hub 132 can be coupled to each of the plurality of legs 106 such that the lower hub 132 is configured to translate along the plurality of legs 106 along the vertical direction V so as to cause the plurality of legs 106 to transition between the first footprint $FP_1$ and the second footprint $FP_2$. The support 124 can be fixed to the lower hub 132 with respect to translation along the vertical direction V and can be translatable relative to the upper hub 126 with respect to the vertical direction V. In at least some examples, the lower hub 132 can be fixed to a lower end of the support 124 and the seat 102 can be fixed to an upper end of the support 124.

The lower hub 132 can have a dimension $d_6$ (see FIG. 16) from the first leg 106(1) to the second leg 106(2) along the first horizontal direction $H_1$. The dimension $d_6$ can be greater than the dimension $d_4$ of the upper hub 126. Similarly, the lower hub 126 can have a dimension $d_7$ (see FIG. 16) from the third leg 106(3) to the fourth leg 106(4) along the second horizontal direction $H_2$. The dimension $d_7$ can be greater than the dimension $d_5$ of the upper hub 126.

The plurality of couplers 114 can couple the legs 106 to the support 124 via the lower hub 132. Thus, it can be said that the couplers 114 indirectly couple the legs 106 to the support 124. Each of one or more of the couplers 114 can be pivotably attached to the lower hub 132 at a pivot 134. In some alternative examples, the couplers 114 could directly couple the legs 106 to the support 124. In other alternative examples, the couplers 114 could couple the legs 106 to the support 124 via one or more components in addition to, or other than, the lower hub 132. For example, the base 104 could comprise at least one linkage that is attached to the support 124 and that is coupled to the legs 106 via the couplers 114.

Referring now to FIGS. 10 to 13, the highchair 100 comprises at least one lock 136 that is configured to selectively lock the highchair 100 in the raised position and the lowered position. In some examples, the at least one lock 136 can be configured to lock the highchair 100 in one or more intermediate positions, between the raised and lowered positions. Each lock 136 can be configured to engage a corresponding one of the legs 106 to lock a position of a corresponding one of the couplers 114 relative to the corresponding leg 106. For example, the highchair 100 can comprise one, two, three, four, or more locks 136, each configured to engage a corresponding leg 106 to lock a position of a respective coupler 114 relative to the corresponding leg 106. In alternative examples, each of the at least one lock can be configured to lock a position of the support 124 relative to the upper hub 126 (see e.g., FIGS. 18 and 19 and related description below).

Referring more specifically to FIGS. 11 to 14, one example is shown in which each lock 136 comprises a protrusion 136*a*, and each corresponding leg 106 defines at least one opening 106*c*, such as a plurality of openings 106*c*, therein that is configured to receive the protrusion so as to lock the position of the support 124 relative to the corresponding leg 106. Each opening 106*c* can correspond to a different position of the highchair 100 such that, when a protrusion 136*a* of a corresponding lock 136 is received in the opening 106*c*, the highchair is locked in the position. For example, individual legs 106 can each comprise a set of openings 106*c* that are spaced apart from one another along a length of the leg 106. The set of openings 106*c* can comprise a lower opening 106*c* corresponding to the lowered position and an upper opening 106*c* corresponding to the raised position. In some examples, the set of openings 106*c* can comprise one or more intermediate openings 106*c* that correspond to one or more intermediate positions. Each lock 136 can be selectively moved into and out of the openings 106*c* of a corresponding set of openings 106*c* to lock the highchair 100 in the different positions.

The highchair 100 can comprise an actuator that is configured to actuate one or more of the locks 136, or each of the locks 136 can be individually actuated without a separate actuator (e.g., each of the locks 136 can be a spring button). FIGS. 10 to 17 show an actuator according to one example that is configured to actuate at least one lock 136, such as four locks 136. It will be understood that, in alternative examples, the actuator can be implemented in any other suitable manner.

The actuator comprises a handle 138 (as best seen in FIG. 6) that is configured to be engaged by a user. The handle 138 can be carried by the seat 102. Movement of handle 138 causes a corresponding movement of each of the at least one lock 136 between a locked position and an unlocked position, such as from the locked position to the unlocked position. In this example, the actuator is configured to convert translational movement of the handle 138 into rotational movement of an axle 140 and rotational movement of the axle 140 into translational movement of the at least one lock 136. To effectuate this movement, the actuator can comprise the axle 140, an upper rotor 142, an upper link 144, a lower rotor 146, and at least one lower linkage 148, such as a lower linkage 148 for each lock 136. In alternative examples, the handle 138 can be carried by a feature other than the seat 102, such as the upper hub 126 or the lower hub 126. When implemented in the lower hub 126, the highchair can be devoid of the upper rotor 142, the upper link 144, and the axle 140, and instead, the handle can directly engage the lower rotor 146 or indirectly engage the lower rotor 146 via a link similar to link 144 so as to rotate the lower rotor 146.

Figure 15:
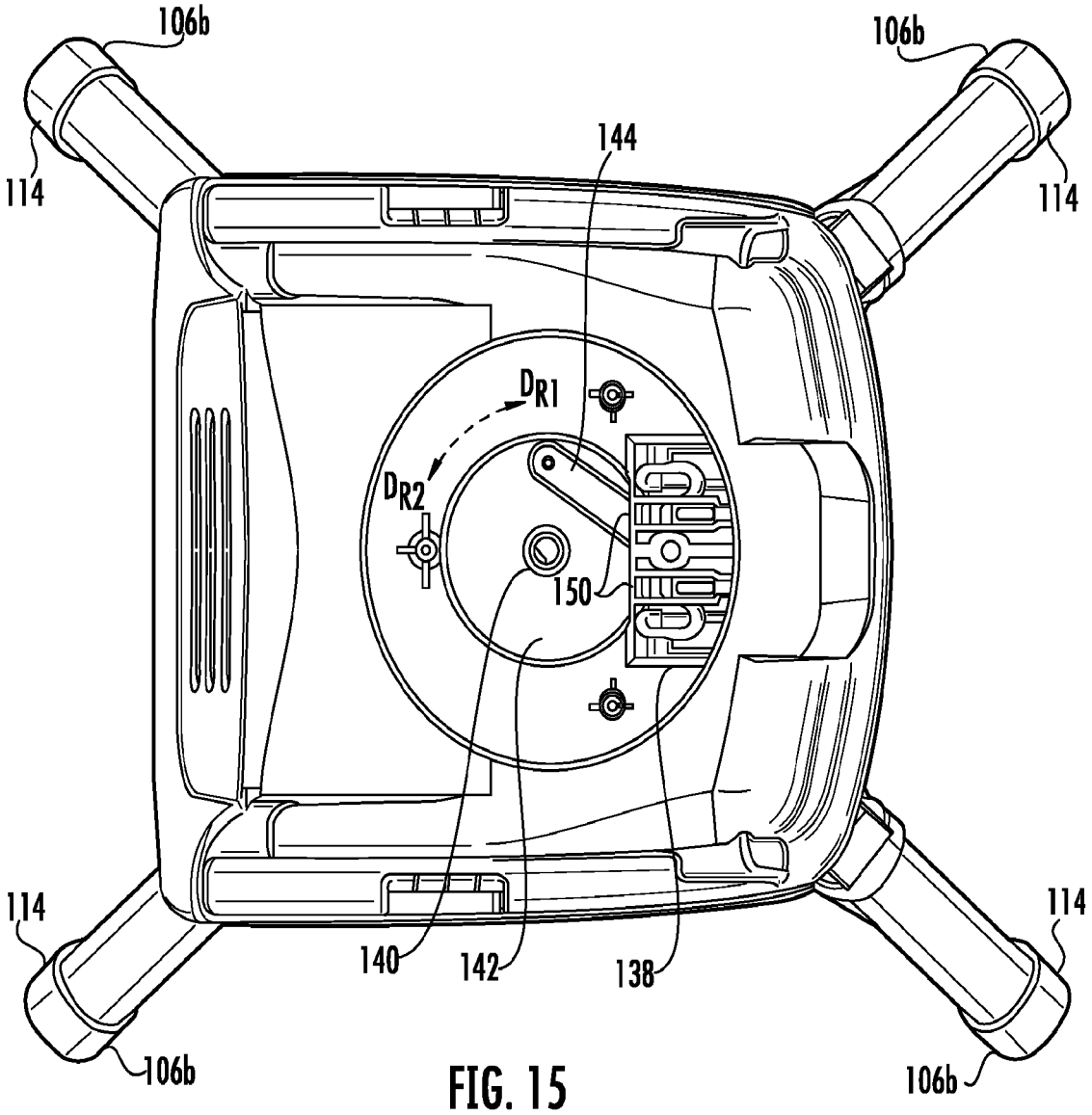
FIG. 15 shows a top plan view of the highchair of FIG. 1 with the booster seat removed and with a cap removed from a pan of the toddler seat so as to expose a portion of an actuator.
Figure 17:
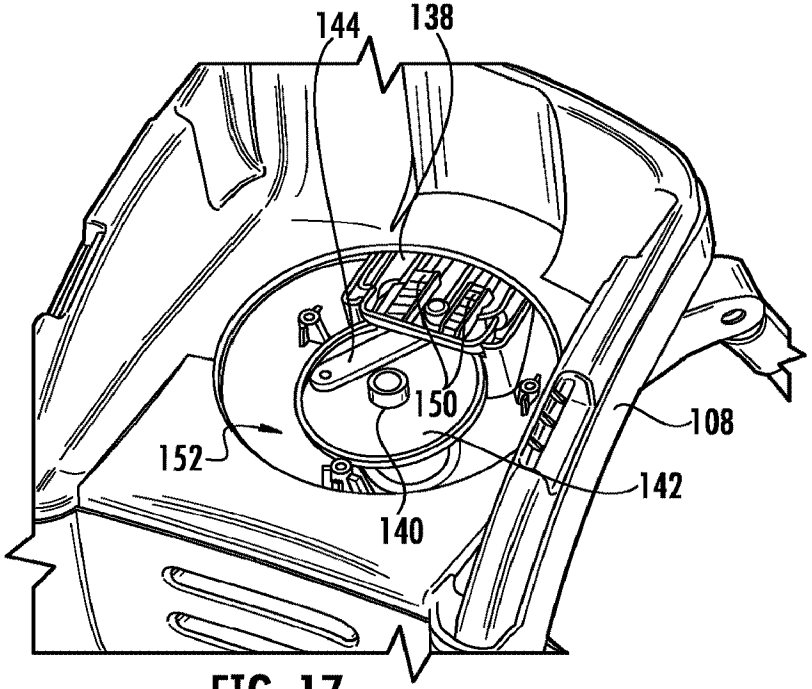
FIG. 17 shows a perspective view of a portion of the highchair of FIG. 1 with the booster seat removed and the cap removed from a pan of the toddler seat so as to expose a portion of the actuator.
Figure 16:
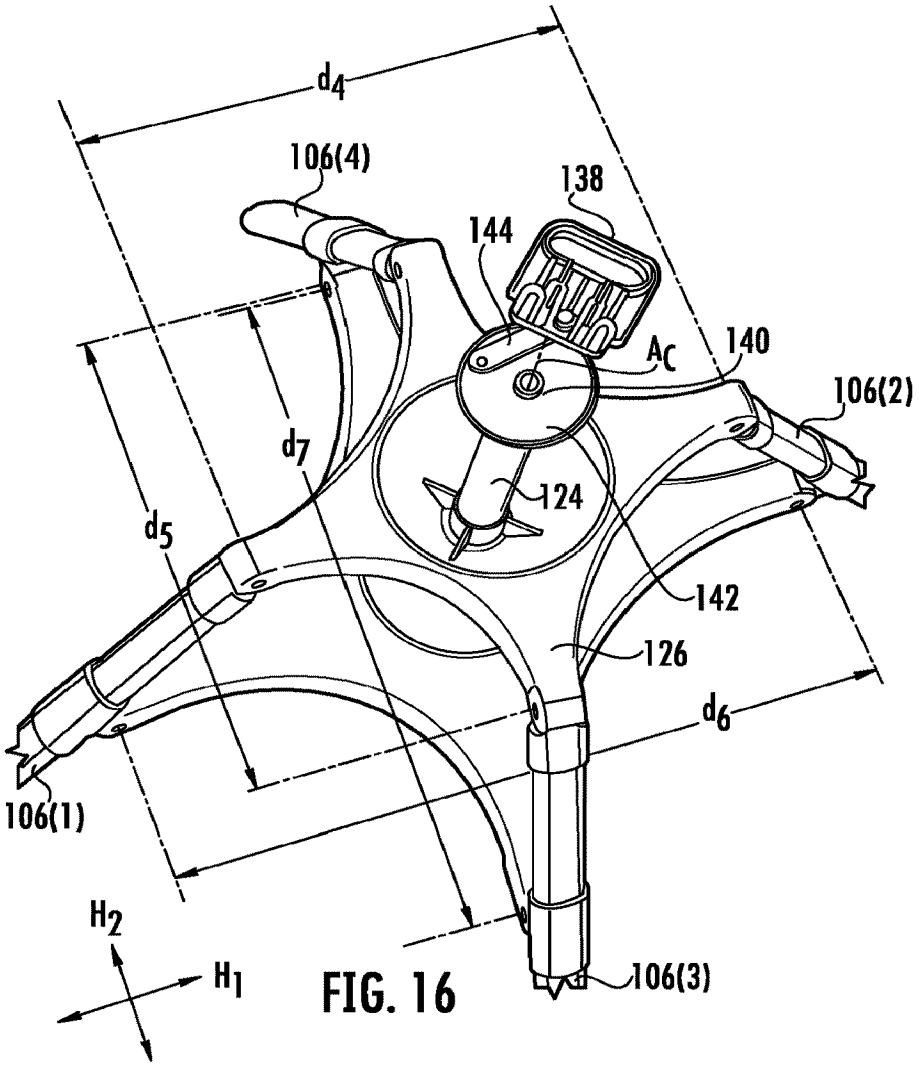
FIG. 16 shows a perspective view of a portion of the highchair of FIG. 1 with the booster seat and toddler seat removed.

Turning more specifically to FIGS. 15 to 17, the axle 140 can extend along the central axis $A_C$. The axle 140 can be shaped as a rod or can have any other suitable shape. The axle 140 can extend through the support 124. In one example, the axle 140 and support 124 can be concentric. The upper rotor 142 can be rotationally fixed to the axle 140 such that rotation of the upper rotor 142 causes a corresponding rotation of the axle 140, and vice versa. The upper rotor 142 can have a disk shape or can comprise a disk. In such examples, the upper rotor 142 can be concentric with the axle 140. As used herein, the term "rotor" refers to a part that rotates or revolves in or relative to a stationary part. It will be understood that the upper rotor 142 can have other suitable shapes, such as an arm or a square plate that rotates, and can be otherwise configured. For example, the upper rotor 142 could be implemented as a pinion gear that is rotatably fixed to the axle 140, and the highchair 100 can comprise a rack gear that is moved by the handle 138 so as to cause the pinion gear to rotate.

The upper link 144 can be pivotably attached to both the handle 138 and the upper rotor 142. For example, the upper link 144 can have a first end that is pivotably attached to the upper rotor 142 at a position that is spaced radially from the central axis $A_C$ and axle 140. The upper link 144 can have a second end that is pivotably attached to the handle 138. The handle 138 can be configured to translate horizontally towards and away from the central axis $A_C$. The actuator can be configured such that, as the handle 138 translates along a radially outward direction, the upper link 144 moves along the radially outward direction, thereby causing the upper rotor 142 to rotate in a first rotational direction $D_{R1}$ to move the at least one lock 136 to an unlocked position. Further, the actuator can be configured such that, as the handle 138 translates along a radially inward direction, the upper link 144 moves along the radially inward direction, thereby causing the upper rotor 142 to rotate in a second rotational direction $D_{R2}$, opposite the first rotational direction $D_{R1}$, to move the at least one lock 136 to locked position.

The actuator can comprise at least one spring 150, such as a plurality of springs, that is configured to bias the handle 138 inwardly so as to maintain the locks 136 in the locked position. The upper rotor 142, the upper link 144, and at least a portion of the handle 138 and at least one spring 150, can be disposed within a cavity 152 in the seat 102, such as within a cavity in the toddler seat 108. The seat 102 can comprise a cap 108*c* (labeled in FIG. 4) that can be removably coupled to the seat pan 108*b*. The cap 108*c* can be removed so as to gain access to the cavity 152.

Turning now more specifically to FIGS. 10 to 14, the lower rotor 146 can be rotationally fixed to the axle 140 such that rotation of the axle 140 causes a corresponding rotation of the rotor 142, and vice versa. The lower rotor 146 can have a disk shape or can comprise a disk. In such examples, the lower rotor 146 can be concentric with the axle 140. However, it will be understood that the lower rotor 146 can have other suitable shapes and can be otherwise configured. The lower rotor 146 can be coupled to each of the at least one lower linkage 148 such that rotation of the lower rotor 146 causes each lower linkage 148 to translate radially inward or radially outward so as to engage each of the at least one lock 136 with a corresponding opening 106*c* of a corresponding leg 106 or disengage the lock 136 each of the at least one lock 136 from a corresponding opening 106*c* of a corresponding leg 106. For example, rotation of the lower rotor 146 in the first rotational direction $D_{R1}$ causes each lower linkage 148 to translate radially inward, thereby disengaging a corresponding one of the locks 136 from a corresponding opening 106*c* of a corresponding leg 106. Further, rotati on of the lowerrotor 146 in the second rotational direction $D_{R2}$ causes each lower linkage 148 to translate radially outward, thereby engaging a corresponding one of the locks 136 with a corresponding opening 106*c* of a corresponding leg 106.

The lower rotor 146 can comprise at least one opening 147 for each lower linkage 148 so as to couple to the lower linkage 148. In some examples, each opening 147 can be shaped as a slot, although examples of the disclose are not so limited. Each opening 147 can be curved or bent. Each opening 147 can extend outward away from the central axis $A_C$ as the opening 147 extends in the first rotational direction $D_{R1}$. Each lower linkage 148 can comprise a protrusion 148*a* (labeled in FIGS. 10 and 14), such as a pin, that is received in a corresponding one of the openings 147 such that the protrusion 148*a* translates within the opening 147 when the lower rotor 146 rotates. Each opening 147 can be defined by a first inner drive surface 147*a* (labeled in FIG. 11). The first inner drive surface 147*a* can be configured to move a protrusion 148*a* of a corresponding one of the lower linkages 148 so as to cause the lock 136 to translate radially inward to an unlocked position. For example, rotation of the lower rotor 146 in the first rotational direction $D_{R1}$ can cause a protrusion 148*a* of a lower linkage 148 to translate along a first inner drive surface 147*a* of a corresponding opening 147 along a radially inward direction, thereby causing the lower linkage 148 and lock 136 to translate radially inward to an unlocked position. Each opening 147 can optionally be defined by a second inner drive surface 147*b* (labeled in FIG. 11). The second inner drive surface 147*b* can be configured to move a protrusion 148*a* of a corresponding one of the lower linkages 148 so as to cause the lock 136 to translate radially outward to a locked position. For example, rotation of the lower rotor 146 in the second rotational direction $D_{R2}$ can cause a protrusion 148*a* of a lower linkage 148 to translate along a second inner drive surface 147*b* of a corresponding opening 147 along a radially outward direction, thereby causing the lower linkage 148 and lock 136 to translate radially outward to a locked position. The second inner drive surface 147*b* can be disposed radially inward of the first inner drive surface 147*a*. In alternative examples, each opening 147 can be devoid of the second inner drive surface 147*b*. In such alternatives, the at least one actuator spring 150 can cause the axle 140 to rotate the lower rotor 146 along the second rotational direction $D_{R2}$, and each of the locks 136 can be translated outwards by a corresponding spring 158 (labeled in FIG. 14).

Referring more specifically to FIGS. 11 to 14, each linkage 148 can have an inner end 148*b*, and an outer end 148*c* that is spaced outwards from the inner end 148*b*. The inner end 148*b* can comprise a protrusion 148*a* that is configured to be received in an opening 147 of the lower rotor 146. The outer end 148*c* call be attached to the lock 136. In some examples, each linkage 148 can comprise an inner link 154 and an outer link 156. The inner link 154 can comprise the protrusion 148*a*, and the outer link 156 can be attached to the lock 136. An outer end 156*a* of the outer link 156 can be pivotably coupled to the lock 136 and an inner end 156*a* of the outer link 156 can be pivotable coupled to the inner link 154. In alternative examples, the outer link 156 could be a flexible link or strap that is or is not pivotably coupled to the lock 136 and/or inner link 154.

Each lock 136 can be attached to a coupler 114 (see FIG. 12) such that the lock 136 is configured to translate with the coupler 114 along the leg 106. Each lock 136 can further be attached to a coupler 114 such that the lock 136, or a portion thereof, is translatable outward relative to the coupler 114 to a locked position and inward relative to the coupler 114 to an unlocked position. For example, each lock 136 can define a slot 136*b* therein that is configured to receive a pin 114*b* that couples the lock 136 to a corresponding coupler 114 such that the pin 114*b* is translatable within the slot 136*b* along the inward and outward direction. Thus, each lock 136 can be supported such that the protrusion 136*a* of the lock 136 is configured to extend into the hole 114*a* in the coupler 114 that receives a corresponding leg 106, and into an opening 106*c* of the corresponding leg 106 so as to lock a position of the highchair 100.

The inner link 154 of each lower linkage 148 can be attached to the lower hub 132 such that the inner link 154 is configured to translate with the lower hub 132 along the vertical direction V. Each inner link 154 can further be attached to the lower hub 132 such that the inner link 154, or a portion thereof, is translatable outward relative to the lower hub 132 to move a corresponding lock 136 to a locked position and inward relative to the lower hub 132 to move a corresponding lock 136 to an unlocked position. For example, each inner link 154 can define a slot 154*a* (labeled in FIG. 13) therein that is configured to receive a pin 132*a* that couples the inner link 154 to the lower hub 132 such that the pin 132*a* is translatable within the slot 154*a* along the inward and outward direction. The highchair 100 can comprise, for each lower linkage 148, a spring 158 that is configured to bias the lock 136 radially outward towards the locked position. Each outer link 156 is pivotably coupled to a corresponding lock 136 and inner link 154 to account for slight variations in movements between a corresponding coupler 114 and the lower hub 132. It will be understood however, that in alternative examples, the inner and outer links 154 and 156 of a lower linkage 148 can be implemented as a single rigid or flexible link.

Figure 19:
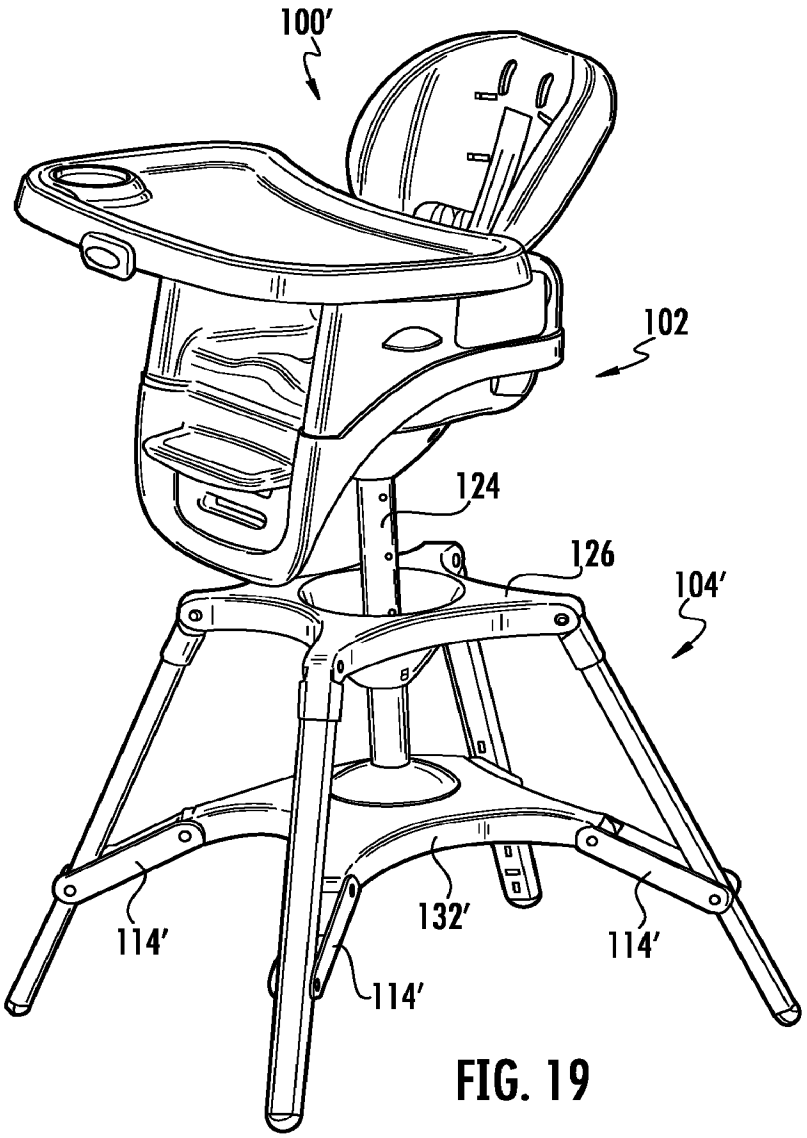
FIG. 19 shows a perspective view of the highchair of FIG. 18 in a raised position.
Figure 18:
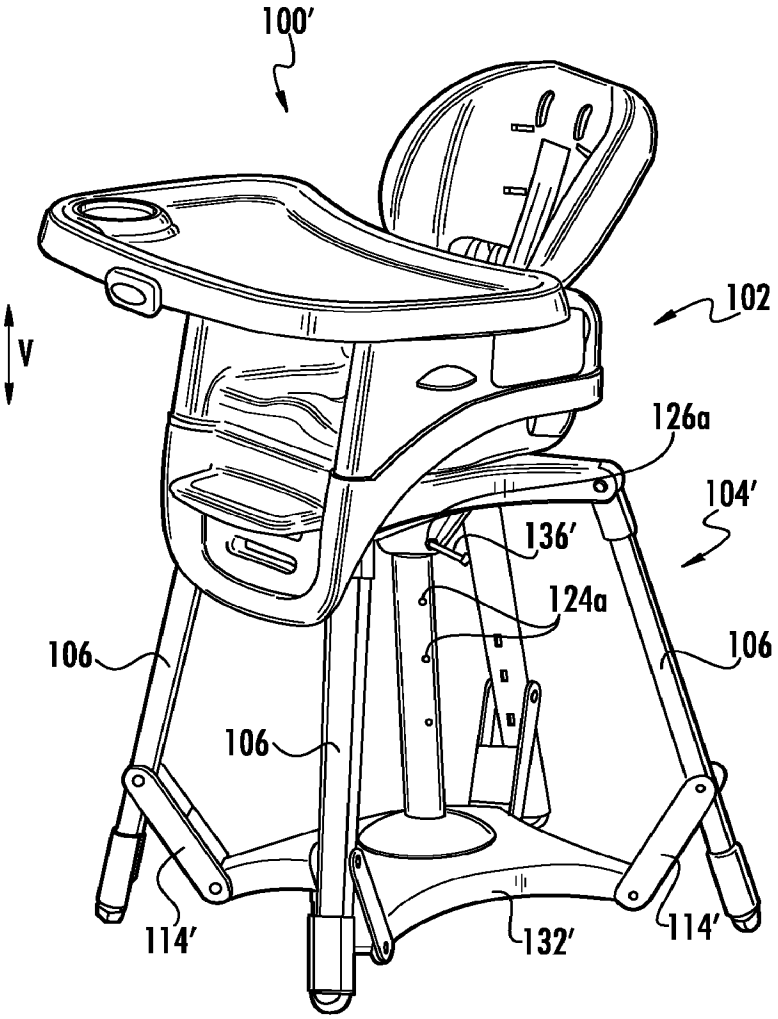
FIG. 18 shows a perspective view of a highchair according to another example in a lowered position.

Turning now to FIGS. 18 and 19, a highchair 100' according to another example is shown. Highchair 100' has a seat 102 that can be configured as discussed above, and a base 104' that is attached to the seat 102 such that, when the base 104' is disposed on a surface such as a floor, the base 104' supports the seat 102 above the surface. The base 104' comprises a plurality of legs 106 that are directly attached to the seat 102 or indirectly attached to the seat 102 via, for example, a support 124. The highchair 100' is configured to transition between a raised position (e.g., FIG. 19) and a lowered position (e.g., FIG. 18). In the raised position, the seat 102 is disposed at a first height and the plurality of legs 106 together define a first footprint $FP_1$ that has a first cross-sectional area in a select plane. In the lowered position, the seat 102 is disposed at a second height, lower than the first height, and the plurality of legs 106 together define a second footprint $FP_2$ that has a second cross-sectional area in the select plane, where the second cross-sectional area is less than the first cross-sectional area. Thus, the highchair 100' is configured such that the seat 102 is configured to raise and lower relative to the base 104' along a vertical direction V.

The base 104' can comprise a plurality of couplers 114' that couple the support 124 to the legs 106. Unlike the couplers 114 of FIGS. 1 to 4, which translate along each leg 106, each coupler 114' is translatably fixed to a corresponding leg 106. In other words, each coupler 114' is fixed to a corresponding leg 106 such that the coupler 114' does not translate along the leg 106. The base 104' can comprise an upper hub 126, which is configured as discussed above. The base 104' can comprise a lower hub 132', which is configured in a manner similar to that discussed above. Each coupler 114' can have an inner end that is coupled to the lower hub 132'. The inner end of each coupler 114' can be pivotably coupled to the lower hub 132'. Each coupler 114' can have an outer end that is coupled to a respective one of the legs 106. The outer end of each coupler 114' can be pivotably coupled to a corresponding one of the legs 106. Each coupler 114' can be a link that couples a corresponding leg 106 to the lower hub 132'.

The base 104' comprises a lock 136' that is configured to fix a position of the seat 102 relative to the base 104'. In some examples, the lock 136' can as simple as a cotter pin or ball lock pin. In other examples, the lock 136' can be any other suitable lock. The lock 136' can be configured to selectively engage the support 124 to lock the highchair 100 in different positions. For example, the lock 136' can be configured to be received through an opening 126*a* of the upper hub 126 and engage openings 124*a* in the support 124 that are spaced apart from one another along the support 124 along the vertical direction V.

Although an example has been disclosed in which the legs rotate so as to increase and decrease the footprint of the highchair as the highchair raised and lowered, examples of the disclosure are not so limited. It will be understood that, in alternative examples, each leg could additionally, or alternatively, translate outwards and inwards along a horizontal direction and/or translate along a vertical direction so as to increase and decrease the footprint of the highchair as the highchair raised and lowered.

According to at least one example, a method of operating a highchair comprises a step of raising a seat of the highchair from a lowered position to a raised position, wherein the raising step causes a plurality of legs of the highchair to rotate, translate outwardly along a horizontal direction, or rotate and translate outwardly along the horizontal direction, so as to increase a footprint defined by the plurality of legs. The method can comprise locking the seat in the raised position after raising the seat to the raised position. The method can comprise, before the raising step, unlocking while the seat while the seat is in the lowered position.

It should be noted that the illustrations and descriptions of the examples and embodiments shown in the figures are for exemplary purposes only, and should not be construed limiting the disclosure. One skilled in the art will appreciate that the present disclosure contemplates various embodiments. Additionally, it should be understood that the concepts described above with the above-described examples and embodiments may be employed alone or in combination with any of the other examples and embodiments described above. It should further be appreciated that the various alternative examples and embodiments described above with respect to one illustrated embodiment can apply to all examples and embodiments as described herein, unless otherwise indicated.

Unless explicitly stated otherwise, each numerical value and range should be interpreted as being approximate as if the word "about," "approximately," or "substantially" preceded the value or range. The terms "about," "approximately," and "substantially" can be understood as describing a range that is within 15 percent of a specified value unless otherwise stated.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While certain examples have been described, these examples are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein. The accompanying claims and their equivalents are intended to cover such forms or modifications as would fall within the scope and spirit of certain of the inventions disclosed herein.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

The words "inward," "outward," "upper," and "lower" refer to directions toward or away from, respectively, the geometric center of the highchair and its components. It will be understood that reference herein to "a" or "one" to describe a feature such as a component or step does not foreclose additional features or multiples of the feature. For instance, reference to a device having, comprising, including, or defining "one" of a feature does not preclude the device from having, comprising, including, or defining more than one of the feature, as long as the device has, comprises, includes, or defines at least one of the feature. Similarly, reference herein to "one of" a plurality of features does not foreclose the invention from including two or more of the features. For instance, reference to a device having, comprising, including, or defining "one of a protrusion and a recess" does not foreclose the device from having both the protrusion and the recess.

What is claimed:

1. A highchair, comprising:

a seat; and a base attached to the seat such that, when the base is disposed on a surface, the base supports the seat above the surface, the base comprising a plurality of legs and a support connected to the seat and coupled to the plurality of legs such that the support is translatable along the plurality of legs so as to cause movement of the seat along the vertical direction and to cause the plurality of legs to rotate and translate horizontally, so as to transition the highchair between 1) a raised position, wherein the seat is disposed at a first height and the plurality of legs together define a first footprint that has a first cross-sectional area in a select plane, and 2) a lowered position, wherein the seat is disposed at a second height, lower than the first height, and the plurality of legs together define a second footprint that has a second cross-sectional area in the select plane that is less than the first cross-sectional area.

2. The highchair of claim 1, wherein the highchair is configured such that movement of the seat from the raised position to the lowered position causes the plurality of legs to rotate inwardly towards a space defined between the legs, and movement of the seat from the lowered position to the raised position causes the plurality of legs to rotate outwardly away from the space.

3. The highchair of claim 1, wherein each leg extends from the surface at a first angle when the highchair is in the raised position and a second angle when the highchair is in the lowered position, the second angle being different from the first angle.

4. The highchair of claim 1, wherein the highchair can be transitioned between the raised position and the lowered position without changing a length of each of the plurality of legs.

5. The highchair of claim 1, wherein the support extends downward from the seat and the base further comprises:

a plurality of couplers that couple the support to the plurality of legs such that each coupler is translatable along a respective one of the plurality of legs so as to cause the support to translate along the vertical direction.

6. The highchair of claim 5, wherein each of one or more of the couplers comprises a slider that is configured to slide along a track defined by a respective one of the plurality of legs.

7. The highchair of claim 5, wherein the support comprises a shaft.

8. The highchair of claim 1, wherein the support extends downward from the seat and the base further comprises:

an upper hub coupled to each of the plurality of legs such that the legs are 1) fixed to the upper hub with respect to translation along the vertical direction, and 2) configured to rotate relative to the upper hub; and a lower hub coupled to each of the plurality of legs below the upper hub such that the lower hub is configured to translate along the plurality of legs along the vertical direction so as to cause the plurality of legs to transition between the first footprint and the second footprint.

9. The highchair of claim 8, wherein the support is fixed to the lower hub with respect to translation along the vertical direction and translatable relative to the upper hub with respect to the vertical direction.

10. The highchair of claim 8, wherein the base comprises a plurality of couplers that couple the lower hub to the plurality of legs such that each coupler is translatable along a respective one of the plurality of legs so as to cause the lower hub to translate along the vertical direction.

11. The highchair of claim 1, wherein the plurality of legs comprises:

a first leg and a second leg that are offset from one another along a lateral direction; and a third leg and a fourth leg that are offset from one another along the lateral direction, wherein the third and fourth legs are offset from the first and second legs along a longitudinal direction, perpendicular to the lateral direction.

12. The highchair of claim 11, wherein the first and second legs are spaced from one another by a first distance, and the first and second legs are spaced from the third and fourth legs by a second distance, greater than the first distance.

13. The highchair of claim 1, comprising at least one lock that is configured to selectively lock the highchair in the raised and lowered positions.

14. The highchair of claim 13, wherein each of the at least one lock is configured to engage a corresponding one of the legs to lock a position of the seat relative to the corresponding leg.

15. The highchair of claim 13, comprising an actuator that is configured to actuate each of the at least one lock.

16. A highchair, comprising:

a seat;

a support that is attached to the seat and extends downward therefrom; and a base comprising a plurality of legs attached coupled to the support such that the support is translatable along the plurality of legs so as to cause movement of the seat along the vertical direction such that 1) the seat is configured to raise and lower relative to the base along a vertical direction, 2) raising the seat causes each of the plurality of legs to move so as to increase a footprint of the base, and 3) lowering the seat causes each of the plurality of legs to move so as to decrease the footprint of the base.

17. The highchair of claim 16, wherein raising the seat increases a space between the seat and the base, and lowering the seat decreases the space between the seat and the base.

18. The highchair of claim 16, wherein the seat can be raised and lowered and the footprint can be increased and decreased without changing a length of each of the plurality of legs.

19. The highchair of claim 16, wherein the highchair is configured such that lowering the seat causes the plurality of legs to rotate inwardly towards a space defined between the legs, and raising the seat causes the plurality of legs to rotate outwardly away from the space.

20. The highchair of claim 16, wherein each leg extends from the surface at a first angle when the highchair is raised and a second angle when the highchair is lowered, the second angle being different from the first angle.

21. The highchair of claim 16, wherein the base comprises:

a plurality of couplers that couple the support to the plurality of legs such that each coupler is translatable along a respective one of the plurality of legs so as to cause the support to translate along the vertical direction.

22. The highchair of claim 21, wherein each of one or more of the plurality of legs has an outer surface that defines a guide configured to guide a respective one of the couplers as the coupler translates along the leg.

23. The highchair of claim 16, wherein the base comprises:

an upper hub coupled to each of the plurality of legs such that the legs are 1) fixed to the upper hub with respect to translation along the vertical direction, and 2) configured to pivot relative to the upper hub; and a lower hub coupled to each of the plurality of legs below the upper hub such that the lower hub is configured to translate along the plurality of legs along the vertical direction so as to cause the footprint to increase and decrease.

24. The highchair of claim 23, wherein the support is fixed to the lower hub with respect to translation along the vertical direction and translatable relative to the upper hub with respect to the vertical direction.

25. The highchair of claim 23, wherein the base comprises a plurality of couplers that couple the lower hub to the plurality of legs such that each coupler is translatable along a respective one of the plurality of legs so as to cause the lower hub to translate along the vertical direction.

* * * * *